United States Patent [19]

Kissel

[11] Patent Number: 4,746,113

[45] Date of Patent: May 24, 1988

[54] AUTOMATICALLY ADJUSTABLE EXERCISE EQUIPMENT, AND CONTROL SYSTEM AND METHOD THEREFOR

[76] Inventor: Robert M. Kissel, 757A Windy Ridge, Manchester, Mo. 63021

[21] Appl. No.: 17,857

[22] Filed: Feb. 24, 1987

[51] Int. Cl.[4] ..... A63B 21/00

[52] U.S. Cl. ..... 272/118; 272/129; 272/DIG. 4

[58] Field of Search ..... 272/117, 118, 123, 125, 272/129, 130, 134, DIG. 4; 128/25 R

[56] References Cited

U.S. PATENT DOCUMENTS

| | | | |
|---|---|---|---|
| 3,573,865 | 4/1971 | Annas et al. | 272/117 |
| 3,869,121 | 3/1975 | Flavell | 272/129 |
| 4,253,662 | 3/1981 | Podolak | 272/123 |
| 4,546,971 | 10/1985 | Raasoch | 272/118 |
| 4,556,214 | 12/1985 | Petrofsky et al. | 272/117 |
| 4,605,221 | 8/1986 | D'Agosta | 272/117 |
| 4,609,189 | 9/1986 | Brasher | 272/129 X |
| 4,610,449 | 9/1986 | Diercks, Jr. | 272/118 |
| 4,650,185 | 3/1987 | Cartwright | 272/129 X |
| 4,657,246 | 4/1987 | Salyer | 272/118 X |

FOREIGN PATENT DOCUMENTS

| | | | |
|---|---|---|---|
| 8000124 | 2/1980 | Int'l Pat. Institute | 272/130 |

*Primary Examiner*—Richard J. Apley
*Assistant Examiner*—Robert W. Bahr
*Attorney, Agent, or Firm*—Polster, Polster & Lucchesi

[57] ABSTRACT

A weight changing system includes a body carrying a plurality of pins which body is fixedly aligned with respect to the top of a weight stack so that the pins carried by the body are aligned with corresponding openings in the weights. The pins are selectively driven from a retracted position in which the pin is not inserted in its corresponding weight opening to an extended position in which the pin is inserted in the corresponding opening. Upon receipt of a signal representative of momentary muscular failure of the user, the pin controllers retract the pin supporting the stack of weights being lifted and insert a higher pin in the opening in its weight to automatically decrease the weight being lifted. Multiple momentary muscular failure points are achievable with this system.

23 Claims, 2 Drawing Sheets

AUTOMATICALLY ADJUSTABLE EXERCISE EQUIPMENT, AND CONTROL SYSTEM AND METHOD THEREFOR

BACKGROUND OF THE INVENTION

This invention relates to exercise equipment and more particularly to exercise equipment which automatically provides a changing workload.

It is known that, for maximum benefit, an athlete in training must push himself to his maximum strength limits. This is difficult to achieve with conventional weight training equipment such as a bench press machine or other general purpose or special purpose machines since generally the athlete has heretofore stopped exercising when he reaches his first point of momentary muscular failure (MMF). At that point, the athlete must either personally change the weight on the machine he is using, or a second person must change the weight for him so that the athlete can continue using the machine. This either unnecessarily interrupts the exercise, or requires the continual presence of a second, non-exercising partner. If the athlete were able to experience multiple MMF's during any one set of a specific exercise, he would eventually reach his absolute fatigue point (AFP). However, with conventional exercise equipment, the AFP is extremely difficult or impossible to reach due to the drawbacks described above.

Consider the case of an athlete lifting 120 pounds while doing bench presses. In this exercise, direct resistance is placed upon pectoral major and anterior deltoids. Soon, for example after only ten complete repetitions, this athlete is no longer able to complete another repetition. As a direct result, he stops exercising, even though he would be able to continue exercising at a lower weight amount, and ultimately reach his AFP. (AFP is the point in which no movement can occur even where the weight amount is as little as 10 per cent of what the athlete began with). At this point the athlete has reached only one MMF point. It is known that a muscle will recover up to 50 per cent of its strength in three seconds. This means that if the athlete was bench pressing 120 pounds ten times, after three seconds of rest he should be able to do up to six more repetitions, thus reaching multiple MMF's which is critical to hypertrophy. As is known, the central key to working out and obtaining results, is to push the muscle beyond its normal everyday demands.

U.S. Pat. No. 4,610,449 to Diercks addresses the particular problem of changing the weights on a conventional exercise machine, but the apparatus shown in Diercks could be improved. In Diercks there is only one solenoid which changes the weight resistance only a single time. Thus, although Diercks is an improvement over conventional exercise equipment in that it allows the user to experience two different weight resistances, it is not capable of providing more than two such resistances for a given use. Moreover, in Diercks the weight is changed at a predetermined time after the exercise starts.

Diercks could be improved since multiple changes of weight is an absolute necessity for reaching absolute muscular failure fatigue. It takes more than one momentary muscular failure point to reach absolute failure point (AFP). Moreover, in exercising the weight must be changed quickly and when the athlete needs the weight to change, not when a predetermined amount of time dictates that the weight is to be changed. A change in the weight should be due to need, namely when the athlete has reached an MMF point, not when a predetermined time expires. Although Diercks could be manually reset after the second MMF point is reached to provide third and fourth MMF's, the time taken in changing the position of the Diercks' apparatus, as described above, allows the muscles to recover sufficiently so that a MMF may not be readily reached at the new weight. Thus, it is very important that the weight be changed quickly.

SUMMARY OF THE INVENTION

Among the various objects and features of the present invention may be noted that the provision of an exercise system which allows an athlete to push himself to his maximum strength limits.

Another object of the present invention is a provision of such a system which automatically lightens the workload as an ahtlete reaches his points of momentary muscular failure.

A third object of the present invention is the provision of such a system which is readily adaptable to conventional exercise equipment already in the field.

A fourth object of the present invention is the provision of such a system which is responsive to momentary muscular failure rather than to elapsed time.

A fifth object of the present invention is the provision of such a system which is capable of multiple changes of weight resistance.

Other objects and features of the present invention will be in part apparent and in part pointed out here and after.

Briefly, the weight lifting machine of the present invention has a vertical stack of weights selectively securable to a lifting bar or the like, each weight including an opening therein communicating with a corresponding opening in the lifting bar by means of which a pin inserted therein may removably secure the weight to the lifting bar. The secured weight and the weights thereabove in the stack are lifted as a unit when the lifting bar is lifted. The lifting bar is operatively connected with a handlebar or the like which is manually operable by the user to lift the lifting bar and the weight carried thereby to provide exercise for the user. The present system includes a body carrying a plurality of pins, which body is fixedly aligned with respect to the top of the weight stack so that the pins carried by the body are aligned with corresponding openings in the weights. Pin drivers are included for selectively driving each pin from a retracted position in which the pin is not inserted in its corresponding weight opening to an extended position in which the pin is inserted in the corresponding opening in the weight and the lifting bar. The system includes means for providing a signal representative of momentary muscular failure of the user and is responsive to such a signal for controlling the pin driver to retract the pin supporting the stack of weights being lifted and insert a second pin in the opening in its weights to automatically decrease the weight being lifted upon receipt of the momentary muscular failure signal. The system is further responsive to a second, later signal representative of momentary muscular failure of the user to retract the second pin and insert a third pin in the opening in its weight to automatically decrease the weight being lifted a second time.

In a second embodiment of the present invention, a control system for a weight lifting machine of the type described above includes a body carrying a plurality of pins vertically fixed with respect to the body, which body is fixedly alignable with respect to the top of the weight stack so that the pins carried by the body are aligned with corresponding openings in the weights. Also included are means for selectively driving each pin from a retracted position in which the pin is not inserted in its corresponding weight opening to an extended position in which the pin is inserted in the corresponding opening in the weight and the lifting bar. Means are included for providing a signal representative of momentary muscular failure of the user and for controlling the pin driving means in response to the momentary muscular failure signal to retract the pin supporting the stack of weights being lifted and insert a second pin in the opening in its weight to automatically decrease the weight being lifted. The providing and controlling means is further responsive to a second, later signal representative of momentary muscular failure of the user to retract the second pin and insert a third pin in the opening in its weight to automatically decrease the weight being lifted a second time.

The method of the present invention includes the steps of detecting a point of momentary muscular failure of a user of a weight training machine, automatically reducing the weight being lifted upon detection of a point of momentary muscular failure, and repeating the previous two steps until a predetemined number of points of momentary muscular failure greater than two have been detected.

BRIEF DESCRIPTION OF THE DRAWINGS

Similar reference characters indicate similar parts throughout the several views of the drawings.

DESCRIPTION OF THE PREFERRED EMBODIMENT

Figure 1:
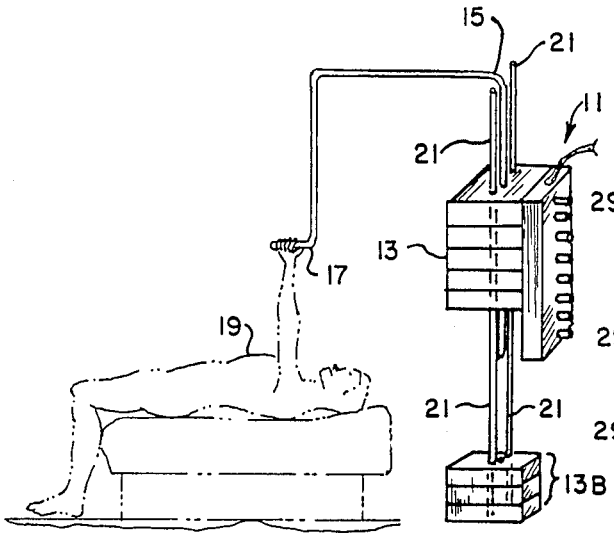
FIG. 1 is a perspective view illustrating the use of the system of the present invention in combination with a conventional weight training machine.

Apparatus 11 of the present invention is shown in FIG. 1 secured to a stack 13 of weights carried by a lifting bar 15 which is mechanically secured as shown to a handlebar 17. The user 19 grasps and pushes on handlebars 17 to lift the stack 13 of weights upwardly and to lower them along a path defined by a pair of guide rails 21. Although guiding rails 21 are shown for controlling the path of movement of stack 13, any conventional means for controlling the path of the stack are included in the present invention.

Although the weight machine is shown as a bench press machine, the present invention is not so limited. It should also be appreciated that the bench press machine shown has been simplified for clarity of illustration. In a practial exercise machine the handle bar 17 could easily be secured by a cable fitted over a pair of pulleys to lifting bar 15 in the conventional manner. For clarity of illustration, the frame of the weight lifting machine has also been removed. The present invention is generally applicable to any weight training machine having a stack of weights securable by a pin to a lifting bar 15, of which many types are known in the art.

Figure 4:
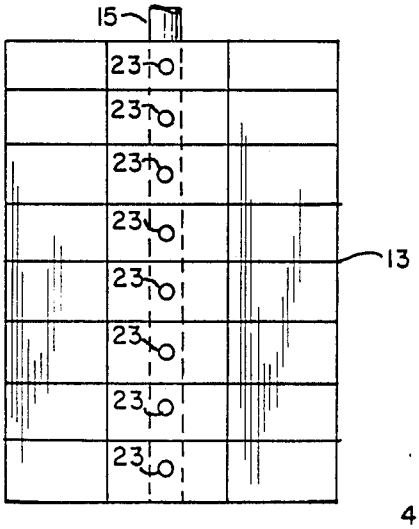
FIG. 4 is a front elevation of a stack of weights for use with the apparatus of FIG. 3.

As shown in FIG. 1, additional weights 13B may be individually secured to lifting bar 15 as desired to increase the weight of stack 13. Similarly, the weight of stack 13 may be reduced by eliminating one or more weights from the stack by suitable insertion and removable of pins. As shown most clearly in FIG. 4, the weights of stack 13 and lifting bar 15 include openings in communication with each other labeled 23. A pin inserted in one of the openings 23 of the weight and the lifting bar causes that weight and each weight positioned above it in the stack to be lifted by the lifting bar while the remaining weights, such as those indicated in FIG. 1 at 13B, are left behind.

Handlebars 17 (FIG. 2) are of any conventional construction but in one embodiment of the present invention include a two-position switch 25 mounted thereon for operation by the user 19 as desired. The purpose of switch 25 is to allow the user to signal when a lesser or greater weight of the stack is desired.

Figure 3:
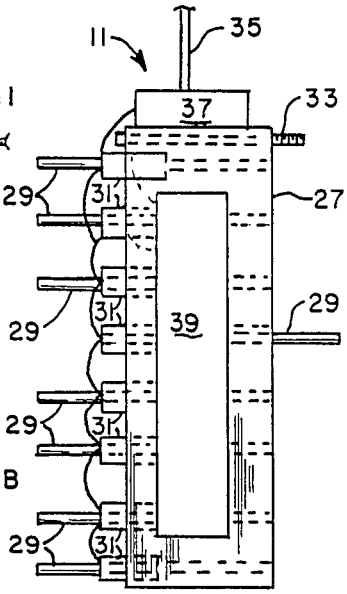
FIG. 3 is a right side elevation of the system of the present invention.

Apparatus 11 (FIG. 3) of the present invention includes a fiberglass body 27 carrying a plurality of pins 29 of suitable size, shape and length for insertion into the openings 23 in weights 13 and lifting bar 15. Fiberglass body 27 also carries a plurality of solenoids 31 for driving their associated pins 29 from the retracted position shown by the top three and bottom four pins 29 to an extended position shown by the fourth pin 29 from the top of apparatus 11 in which the pin 29 is inserted through the openings 23 in its corresponding weight 13 and lifting bar 15. Body 27 is suitably secured to the top weight of the stack by one or more threaded fasteners 33 or in any other suitable manner.

Figure 7:
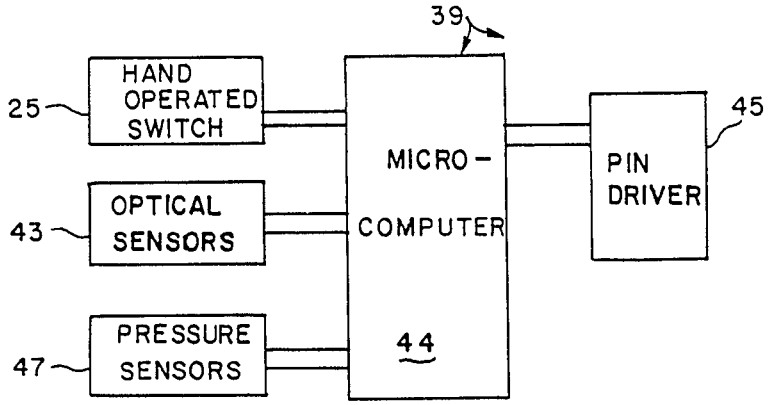
FIG. 7 is a block diagram of control circuitry of the present invention.

Apparatus 11 is connected by means of a cable 35 to a power source not shown. If this is an AC power source, body 27 may also carry suitable rectifying circuitry 37 for powering solenoids 31 and a control circuit 39. Although control circuit 39 may be implemented using discrete components, it is preferred that the circuit 39 include a microcomputer as shown in FIG. 7. Control circuit 39 controls, in the manner described below, which pin 29 is in the extended position to cause its corresponding weight of stack 13 and all the weights in the stack thereabove to be lifted by lifting bar 15.

Figure 5:
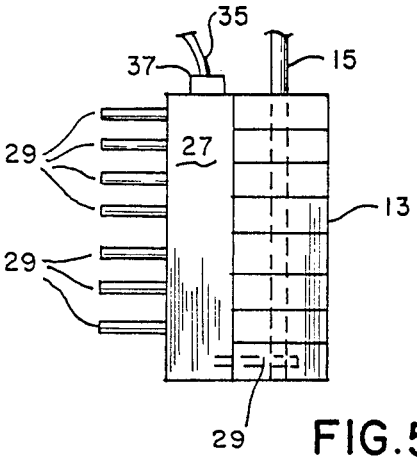
FIG. 5 is a left side schematic illustrating the use of the apparatus of FIG. 3.

FIG. 5 illustrates the situation in which the lowestmost pin 29 is inserted through the openings 23 in its corresponding weight and lifting bar. In this case, the entire stack of weights is lifted by the user when he pushes upwardly on handlebar 17. As required, the lowermost pin is automatically retracted by control circuit 39 and a higher pin such as the second lowermost pin 29 is inserted in its corresponding openings to decrease the weight in the stack by one. Of course, control circuit 39 could be programmed to cause the weight to change by an increment of more than one weight if desired.

Figure 6:
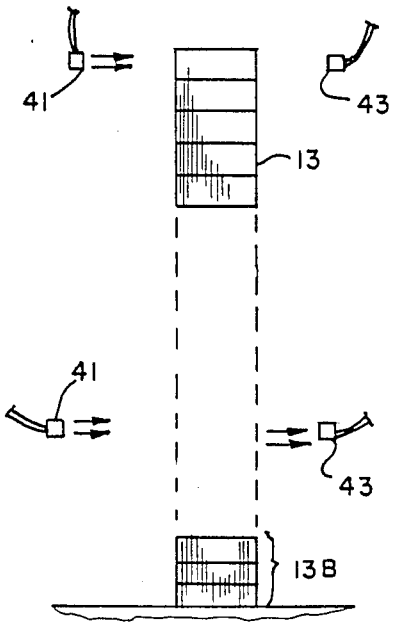
FIG. 6 is a schematic illustrating position sensing circuitry of the present invention.

In FIG. 6, a pair of optical detectors including an optotransmitter 41 and an optodetector 43 are shown in combination with stack 13. The uppermost pair of optotransmitter 41 and optodetector 43 detect when the stack 13 is lifted by the user to its highest position, while the lower pair is used to detect when the stack is returned to the lower or rest position.

Control circuit 39 (FIG. 7) preferably includes a microcomputer 44 having control outputs labelled as pin drivers 45 suitably arranged to actuate the desired one of solenoids 31 as necessary to extend the desired pin into stack 13. The pin drivers 45 include solenoids 31 and any associated interface circuitry made necessary by the particular microcomputer and solenoids being used. Microcomputer 44 may optionally include a number of different inputs including hand operated switch 25 and optical sensors 43. If desired, pressure sensors 47 may provide an input to microcomputer 44 to indicate when the pressure exerted by the user has decreased to a point indicative of a momentary muscular failure. It should be realized that these inputs are alternatives, but that various combinations thereof may be used in any particular system.

Figure 2:
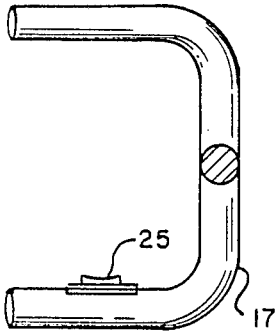
FIG. 2 is a top plan of the handlebars used in connection with the weight training machine of FIG. 1.

Apparatus 11 may optionally be operated in two different modes. In the first mode, the hand operated switch 25 of FIG. 2 is used by the user 19 to signal the request for an increase or decrease in the weight in the stack. In the second mode, microcomputer 44 senses through optical sensors 43, or pressure sensors 47, or other suitable sensors that a point of momentary muscular failure has been reached and thereupon lightens the weight.

For example, an athlete 19 bench pressing 120 pounds in reaches his momentary muscular failure point in ten repetitions. With the apparatus of the present invention, he may actuate switch 25 in a first direction to automatically lighten the workload and thus continue exercising. Closure of switch 25 in the first direction causes control circuit 39 to withdraw the pin 29 which is then currently inserted in openings 23 in the weights and lifting bar 15 and insert the next higher pin 29 into its corresponding openings 23. This action reduces the weight in the stack 13 by one. Of course, control circuit 39 could be programmed to decrease the total weight by two or three weights by suitable insertion of the proper pin 29. In any event, this new total weight should be heavy enough to evoke another momentary muscular failure point within ten repetitions. The athlete will most likely be able to do about eight repetitions. At eight repetitions, he reaches his second momentary muscular failure point. By pressing switch 25 in the first direction again, the weight is automatically reduced, allowing the athlete to continue. The next momentary muscular failure may occur at only five repetitions, which is momentary muscular failure point three. By now the weight load could be reduced to twenty-five per cent of what the athlete began with, i.e., thirty pounds. After another momentary muscular failure, the weight is changed again to fifteen pounds. But finally, another repetition is no longer possible even at fifteen pounds. Note that with this arrangement, the athlete is able to reach his absolute fatigue point because more than one momentary muscular failure point can be achieved. This stimulates the muscle more effectively and efficiently.

Switch 25 is a two-position switch. In the event that the user closes switch 25 in its second position, control circuit 39 is responsive to that switch closure to insert a pin 29 lower in the stack than that pin currently inserted. Thus, closure of switch 25 in the second position results in the weight in the stack being increased. This feature can be used by the athlete to initially set the weight being lifted or to increase the weight being lifted in those situations where the weight of the stack at the start turns out to be too light.

Figure 8:
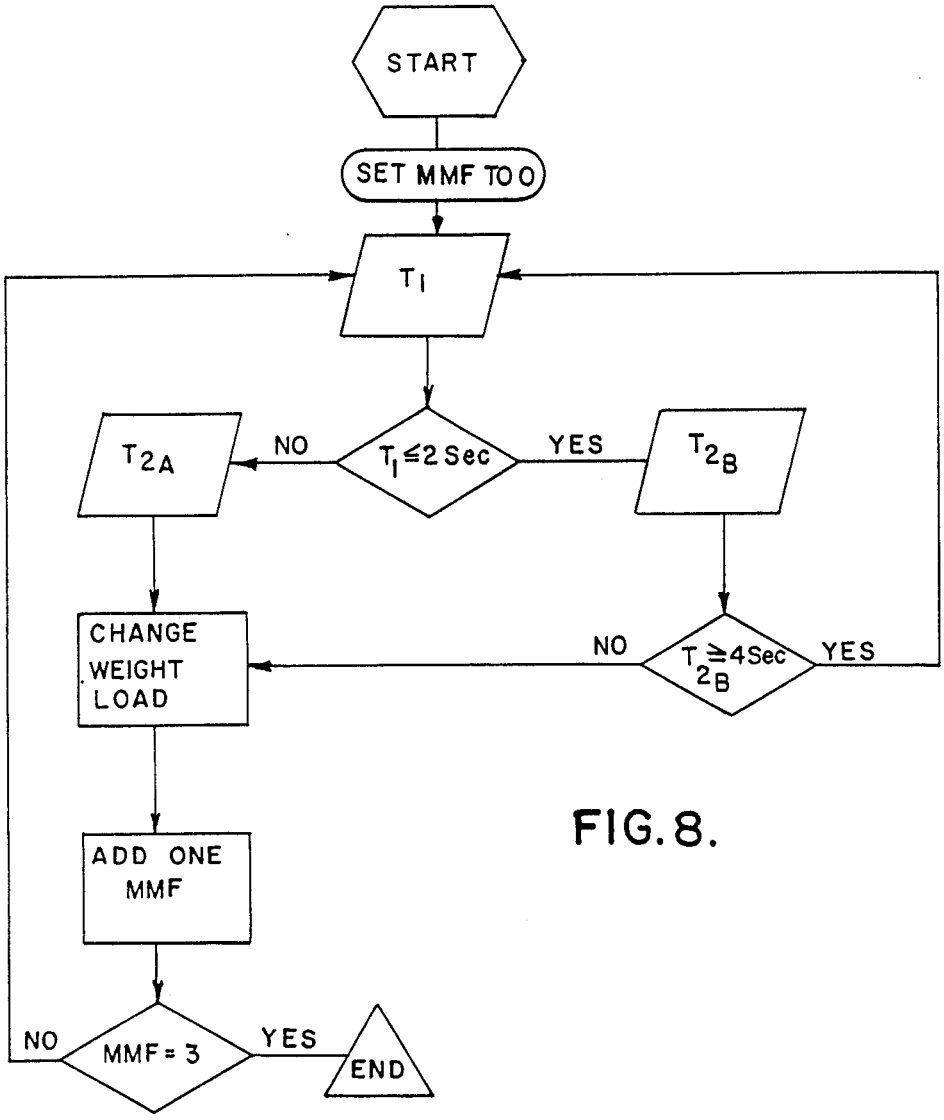
FIG. 8 is a block diagram of a flowchart of the system of FIG. 7.

In the second mode of operation, when the computer or other control circuitry controls the changing of the weights, control circuit 39 senses when the weight should be reduced and does so automatically. For example, by the use of optical sensors 43, microcomputer 44 can sense the time it takes the athlete to raise the weights to the uppermost position and the time the athlete takes to then lower the weights to the rest position. A normal rate for lifting weights would be two seconds up (the positive portion of the exercise), a one second pause, followed by four seconds down (the negative portion of the exercise). FIG. 8 is a flowchart which illustrates the operation of microcomputer 44 in these circumstances. At the start of the exercise the microcomputer sets a buffer called MMF to zero to indicate that no momentary muscular failures have occured. The microcomputer then measures, through the use of sensors 43, the time T1 it takes the athlete 19 to lift the stack to its uppermost position. If the time T1 is less than or equal to two seconds, this indicates that no momentary muscular failure has occured. So the computer then measures a time T2B which represents the time it takes the user who has not as yet undergone momentary muscular failure to lower the stack from its uppermost position to its rest position. If time T2B is greater than or equal to four seconds, the point of momentary muscular failure has still not been reached so the computer recycles to again measure time T1 for the next repetition of the exercise.

On the other hand, if time T2B is less than four seconds or if time T1 is greater than two seconds, these conditions indicate that a point of momentary muscular failure has been reached. In each case, microcomputer 44 controls pin drivers 45 to lighten the load in stack 13 by the suitable retraction and injection of pins 29. The computer then adds one to the momentary muscular failure total and then tests to see whether the total number of momentary muscular failures equals three. If the total number of momentary muscular failures does equal three, the computer program ends. In the event that three momentary muscular failures have not been reached, the computer recycles to measure T1 for the next repetition of the exercise. Of course, it should be realized that the times of two seconds and four seconds set forth in this description are merely illustrative and could be changed as desired for different exercise machines and the like. In addition, the present invention is certainly not limited to three momentary muscular failure points. The apparatus 11 may be programmed to provide as many momentary muscular failure points as desired.

It should also be realized from the above description that microcomputer 44 may be used to initially set the weight of stack 13. In the event that the athlete 19 begins exercise with the stack and the time T1 it takes him or her to lift the stack to its uppermost position is below a preset threshhold, this will indicate that the weights on the stack are too light, so microcomputer 44 can automatically insert one or more additional weights to slow down the speed of the repetitions. In addition, switch 25 may be used in combination with microcomputer 44 if desired for both automatic and manual control of weight changing apparatus 11. Other modifications and combinations will be apparent to one of ordinary skill in the art.

In view of the above, it will be seen that the various objects and features of this invention are achieved and other advantageous results obtained. As various changes could be made in the above constructions and methods without departing from the scope of the invention, it is intended that all matter contained in the above description or shown in the accompanying drawings shall be interpreted as illustrative and not in a limiting sense.

What is claimed is:

1. A control system for a weight training machine of the type having a vertical stack of weights selectively securable to a lifting bar or the like, each weight including an opening therein communicating with a corresponding opening in the lifting bar by means of which a pin inserted therein may removably secure said weight to the lifting bars, whereby said secured weight and the weights thereabove in the stack are lifted as a unit when the lifting bar is lifted, means operatively connected to the lifting bar and manually operable by the user to lift the lifting bar and the weights carried thereby to provide exercise for the user, said control system comprising:

a body carrying a plurality of pins vertically fixed with respect to the body, said body being fixedly alignable with respect to the top of the weight stack so that the pins carried by the body are aligned with corresponding openings in the weights;

means for selectively driving each pin from a retracted position in which the pin is not inserted in its corresponding weight opening to an extended position in which the pin is inserted in the corresponding opening; and means for providing a signal representative of momentary muscular failure of the user and for controlling the pin driving means in response to the momentary muscular failure signal to retract the pin supporting the stack of weights being lifted and insert a second pin in the opening in its weight to automatically decrease the weight being lifted, said providing and controlling means being further responsive to a second, later signal representative of momentary muscular failure of the user to retract said second pin and insert a third pin in the opening in its weight to automatically decrease the weight being lifted a second time.

2. The control system as set forth in claim 1 wherein the body includes a pin for each selectable weight, said pins being aligned with the respective openings in the weights of the stack.

3. The control system as set forth in claim 1 wherein the providing and controlling means includes sensor means for sensing the rate at which the user lifts and lowers the weight stack during exercise.

4. The control system as set forth in claim 3 wherein the providing and controlling means is responsive to the time the user takes to lift the weight stack exceeding a predetermined time to reduce the weight in the stack.

5. The control system as set forth in claim 3 wherein the providing and controlling means is responsive to the time the user takes to lower the weight stack falling below a predetermined time to reduce the weight in the stack.

6. The control system as set forth in claim 1 wherein the providing and controlling means includes a manually actuable switch disposed adjacent the manually operable lifting means to provide the momentary muscular failure signal when the user actuates the switch, said providing and controlling means being responsive to a signal from the manually actuable switch to reduce the weight operatively connected to the stack.

7. The control system as set forth in claim 6 wherein the manually actuable switch includes a second switch position in which it generates a second signal, said providing and controlling means being responsive to the second signal to increase the weight operatively connected to the stack.

8. In a weight training machine with a vertical stack of weights selectively securable to a lifting bar or the like, each weight including an opening therein communicating with a corresponding opening in the lifting bar by means of which a pin inserted therein may removably secure said weight to the lifting bar, whereby said secured weight and the weights thereabove in the stack are lifted as a unit when the lifting bar is lifted, and means operatively connected to the lifting bar and manually operable by the user to lift the lifting bar and the weights carried thereby to provide exercise for the user, the improvement comprising:

a body carrying a plurality of pins, said body being fixedly aligned with respect to the top of the weight stack so that the pins carried by the body are aligned with corresponding openings in the weights;

means for selectively driving each pin from a retracted position in which the pin is not inserted in its corresponding weight and lifting bar openings to an extended position in which the pin is inserted in the corresponding openings;

means for providing a signal representative of momentary muscular failure of the user and for controlling the pin driving means in response to the momentary muscular failure signal to retract the pin supporting the stack of weights being lifted and insert a second pin in the opening in its weight to automatically decrease the weight being lifted, said providing and controlling means being further responsive to a second later signal representative of momentary muscular failure of the user to retract said second pin and insert a third pin in the opening in its weight to automatically decrease the weight being lifted a second time.

9. The weight training machine as set forth in claim 8 wherein the body includes a pin for each selectable weight, said pins being aligned with the respective openings in the weights of the stack.

10. The weight training machine as set forth in claim 8 wherein the providing and controlling means includes sensor means for sensing the rate at which the user lifts and lowers the weight stack during exercise.

11. The weight training machine as set forth in claim 10 wherein the providing and controlling means is responsive to the time the user takes to lift the weight stack exceeding a predetermined time to reduce the weight in the stack.

12. The weight training machine as set forth in claim 10 wherein the providing and controlling means is responsive to the time the user takes to lower the weight stack falling below a predetermined time to reduce the weight in the stack.

13. The weight training machine as set forth in claim 8 wherein the providing and controlling means includes a manually actuable switch disposed adjacent the manually operable lifting means to provide the momentary muscular failure signal when the user actuates the switch, said providing and controlling means being responsive to a signal from the manually actuable switch to reduce the weight operatively connected to the stack.

14. The weight training machine as set forth in claim 13 wherein the manually actuable switch includes a second switch position in which it generates a second signal, said providing and controlling means being responsive to the second signal to increase the weight operatively connected to the stack.

15. A method of operating a weight training exercise machine having a plurality of machine selectable weights to be repetitively lifted during an exercise by a user, comprising the steps of:

(1) electronically measuring at least one time associated with a repetition of the exercise by the user, said time being a function of the muscular state of the user at that point during the exercise;

(2) automatically and without human intervention changing the weight being lifted upon the electronically measured time falling outside a predetermined range so as to maximize the muscular effort exerted by the user; and (3) repeating steps (1) and (2) for each repetition of the exercise until the occurrence of a predetermined condition signalling the end of the exercise.

16. The method as set forth in claim 15 wherein the electronically measured time falling outside its predetermined range represents a momentary muscular failure and wherein the predetermined condition is the occurrence of more than two instances of the electronically measured time falling outside its predetermined range.

17. The method as set forth in claim 15 wherein the electronically measured time falling outside the predetermined range indicates momentary muscular failure.

18. The method as set forth in claim 17 wherein the amount by which the weight is reduced after a point of momentary muscular failure is reached is sufficiently small to insure that the next point of momentary muscular failure will occur within a relatively small, predetermined number of repetitions by the user.

19. The method as set forth in claim 18 wherein the predetermined number of repetitions is ten or less.

20. The method as set forth in claim 17 wherein the electronically measured time is the time it takes the user to lift the selected weight, a time in excess of the maximum time in the predetermined range representing momentary muscular failure.

21. The method as set forth in claim 17 wherein the electronically measured time is the time it takes the user to lower the weight stack, a time less than the minimum time in the predetermined range representing momentary muscular failure.

22. The method as set forth in claim 15 wherein when at least one time associated with a repetition of the exercise by the user falls outside its predetermined range, the weight being lifted is automatically increased.

23. The method as set forth in claim 22 wherein the electronically measured time is the time it takes the user to life the selected weight, a time less than the minimum time in the predetermined range resulting in an automatic increase in the weight being lifted.

* * * * *

UNITED STATES PATENT AND TRADEMARK OFFICE

CERTIFICATE OF CORRECTION

PATENT NO. : 4,746,113

DATED : May 24, 1988

INVENTOR(S) : Robert M. Kissel

It is certified that error appears in the above-identified patent and that said Letters Patent is hereby corrected as shown below:

Claim 23, Column 10, Line 31, "to life" should read --to lift--.

Signed and Sealed this

Fifteenth Day of November, 1988

*Attest:*

DONALD J. QUIGG

*Attesting Officer*

*Commissioner of Patents and Trademarks*